United States Patent [19]

Stevens et al.

[11] 3,993,138

[45] Nov. 23, 1976

[54] FIRE PREVENTION SYSTEM

[75] Inventors: Ralph B. Stevens, Santa Clara; Walter S. Oda, San Jose, both of Calif.

[73] Assignee: The United States of America as represented by the Secretary of the Interior, Washington, D.C.

[22] Filed: Apr. 24, 1975

[21] Appl. No.: 571,180

[52] U.S. Cl. ..... 169/61; 169/62; 340/410

[51] Int. Cl.[2] ..... A62C 37/22

[58] Field of Search ..... 169/60, 61, 62, 9, 23; 340/410, 411

[56] References Cited

UNITED STATES PATENTS

| | | | |
|---|---|---|---|
| 2,639,418 | 5/1953 | Sundstrom et al. | 340/411 X |
| 3,553,664 | 1/1971 | Tucker | 340/410 X |
| 3,594,788 | 7/1971 | Seelig | 340/410 |
| 3,668,674 | 6/1972 | Westendorf | 340/410 X |
| 3,865,192 | 2/1975 | Dunphy | 169/19 X |

*Primary Examiner*—Evon C. Blunk
*Assistant Examiner*—Michael Mar
*Attorney, Agent, or Firm*—Gersten Sadowsky; Donald R. Fraser

[57] ABSTRACT

An automatic fire prevention system provides failsafe features as well as the capability of checking the operation of associated fire sensors. Multiple fire sensors, including thermal and optical types, are continually checked by a test circuit which simulates fire conditions. Detection of an actual fire causes an automatic control circuit, after a predetermined time delay, to activate a fire extinguishing device such as a dry powder chemical extinguisher. Logic circuitry distinguishes between true fires and fires simulated by the aforementioned test circuit. An operator can by-pass the automatic activation of the fire extinguishing device by means of a manual switch during the time delay period and can also manually discharge the fire extinguisher. Applications include the protection of mine haulage trucks so as to provide automatic fire extinguisher activation, continued self-checking and manual override features for a driver.

15 Claims, 6 Drawing Figures

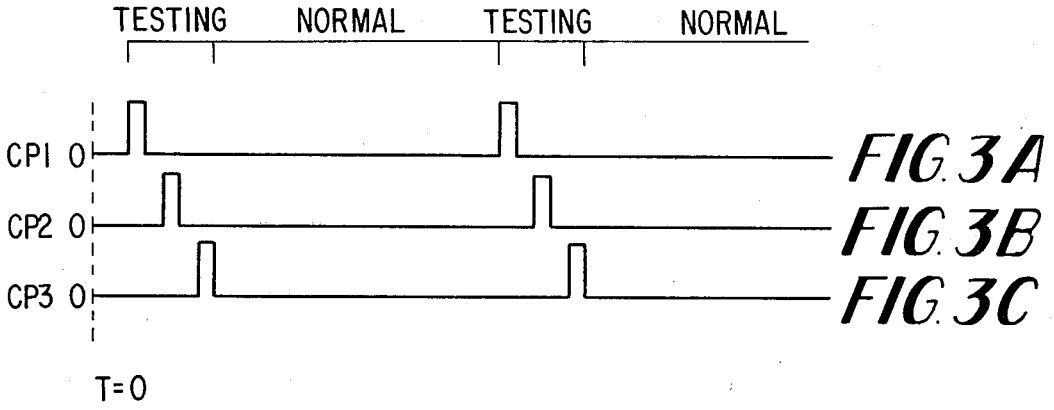
FIG. 4
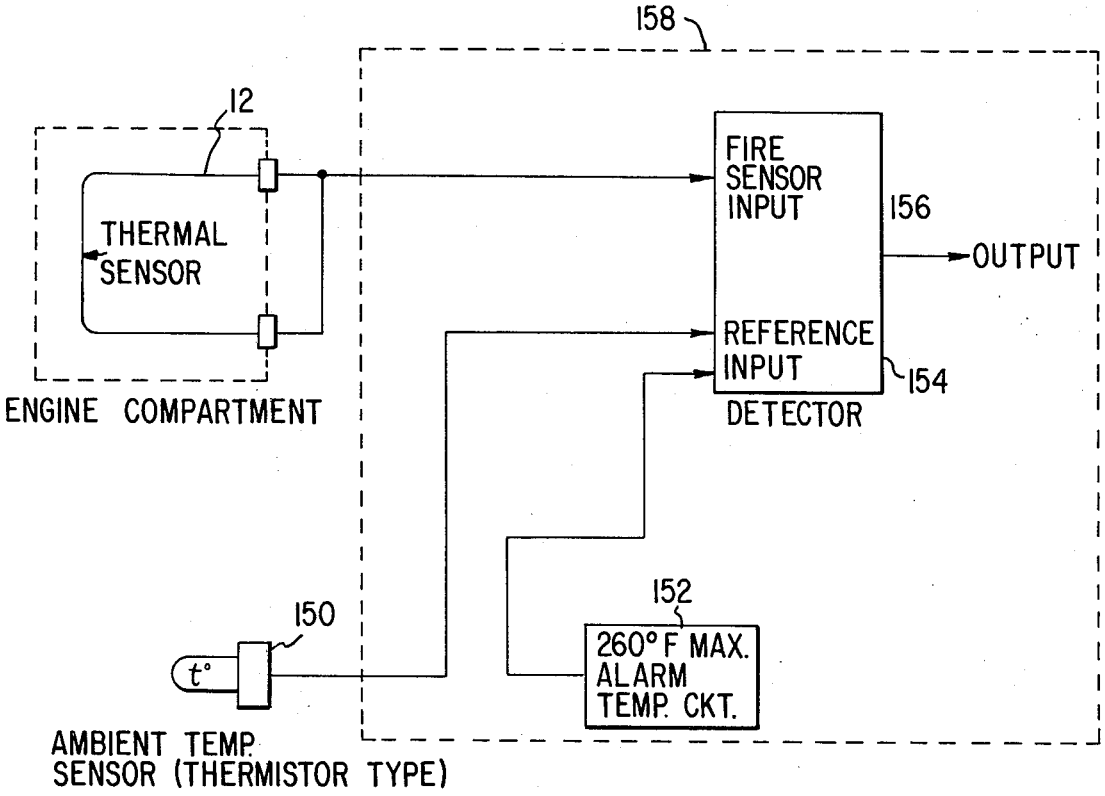

FIRE PREVENTION SYSTEM

FIELD OF THE INVENTION

This invention relates to fire protection systems, and, more particularly, to a high reliability fire protection system having failsafe features and a self-checking capability.

BACKGROUND OF THE INVENTION

Certain operating conditions, such as those encountered in a mine haulage truck, require a fire protection system that provides an operator with an immediate indication of the existence of a fire and that can do this with a high degree of reliability. In the case of a mine haulage truck, the operator is located 10 or more feet above the ground and safety requires that he be able to extinguish a fire quickly, or that he at least be warned in time so that he can leave the vehicle before a given danger level is reached. While conventional alarm systems provide some of the necessary features to satisfy the rigid requirements set forth above, none provide the necessary combination of high reliability automatic operation together with suitable operator control so as to insure driver safety.

SUMMARY OF THE INVENTION

According to the present invention, a high reliability fire protection system is provided which overcomes many of the problems associated with prior art systems and which, inter alia, provides automatic failsafe operation as well as suitable operator control.

The system includes multiple fire sensors, including thermal wire loops and optical sensors, for monitoring conditions in various key locations, for example, in the engine compartment and in the brake grid of a truck. Upon the sensing of a fire condition, control logic circuitry provides an indication to the driver, by visual and/or audible devices, of the location of the fire. A time delay is provided in order to give the operator time to reset the system, in the case, for example, of a false alarm or of a highly localized fire which the operator would prefer to extinguish by hand, or to manually activate fire extinguishing equipment under his control without the prescribed time delay. If after the aforementioned time delay, no action has been taken by the operator, control logic will automatically activate fire extinguishing apparatus. The latter operation takes place where, for example, the operator is disabled or leaves the vehicle at the time of the initial fire warning. Thus, failsafe operation of the fire fighting equipment is assured.

The present invention also provides for the continual checking of the fire sensors to assure their proper operation. Continuity of thermal fire sensors and their associated circuits are checked at regular intervals. This is done by simulating fire conditions to all sensors at regular intervals and using control logic to check the operation of each sensor and, at the same time, to disconnect the fire sensors from the alarm and fire extinguisher activating circuits so as to avoid false triggering during the simulated fires. By using short test pulses for fire simulation, the delay between the simulation of a fire condition and the detection of a true fire condition is reduced to the order of milliseconds.

According to a further feature of the invention, thermal wire loops with ambient temperature comparison sensors are used during ambient temperature extremes so as to provide faster alarm in cold climates without introducing false alarms in hot climates.

Other features and advantages of the invention will be set forth in, or will be apparent from, the detailed description of the preferred embodiments found hereinbelow.

BRIEF DESCRIPTION OF THE DRAWINGS

FIGS. 3A, 3B and 3C are timing diagrams representing the relationships of three clock pulses utilized in the circuitry of FIG. 2; and FIG. 4 is a simplified diagrammatic block representation of control logic of a preferred embodiment of an ambient temperature compensating thermal wire loop.

DESCRIPTION OF THE PREFERRED EMBODIMENT

Figure 1:
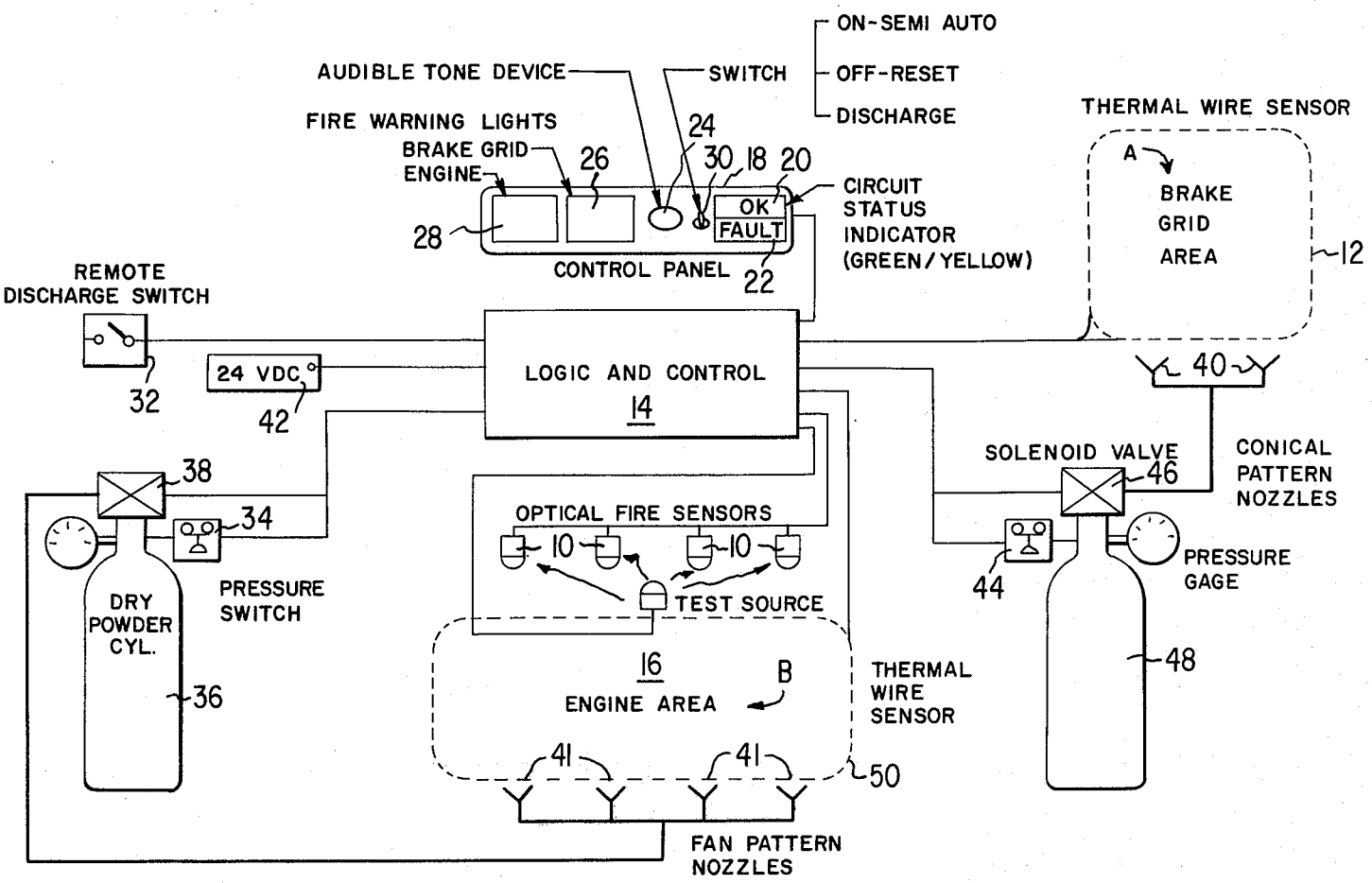
FIG. 1 is a simplified schematic diagram of a preferred embodiment of the invention adapted for use in a mine haulage truck.

Referring to FIG. 1, an exemplary fire protection system for a mine haulage truck is shown. Two vital areas are monitored by the system, a brake grid area indicated at A and an engine area indicated at B. A fire in brake grid area A is highly dangerous due to the difficulty of early detection and the possible dire consequences resulting from damaged or inoperable brakes. A fire in engine area B is also exceedingly dangerous because, in most mine haulage trucks, the ladder that a driver uses to leave the driver's cab is above the engine compartment, thereby requiring a driver to leave his cab through the fire.

Brake grid area A is protected by a loop of thermal wire indicated at 12. The resistance of thermal wire 12 drops when the wire is heated. This resistance is monitored by logic and control electronics indicated by block 14. If the resistance of thermal loop 12 drops below a pre-set value, the logic and control electronics 14 will initiate an alarm process described hereinbelow. Control unit 14 also discriminates between conditions of falling resistance (due to fire) and no resistance (due to a short) and will activate a warning device on a control panel 18 in the event of a short circuit.

The engine area B is protected by a thermal loop 50 which is similar in construction and operation to loop 12 in brake grid area A. The engine area B is also protected by at least one of a plurality of optical fire sensors 10.

According to a preferred embodiment, optical sensors 10 are infra-red (IR) to ultra-violet (UV) ratio detectors, each sensor providing both infra-red detection and ultra-violet detection. Under normal operating conditions, the ratio between IR and UV remains approximately constant. During a fire, the quantity of IR light goes up drastically and the electrical outputs of ratio sensors 10 will vary accordingly. Control unit 14 monitors optical sensors 10 and starts an alarm process which is discussed hereinbelow and is similar to that for thermal loops 12 and 50 mentioned hereinabove.

Upon sensing a fire condition at either brake grid area A or engine compartment B, control unit 14 immediately notifies the driver of that condition by turning on a visual indicator 26 for brake grid area A or a visual indicator 28 for engine area B and simultaneously activating audible warning device 24, indicators 26 and 28 and warning device 24 all being located on control panel 18 positioned inside the driver's cab. At this time, control unit 14 provides a pre-set time delay so as to permit the driver to react to the signalled condition. A three position switch 30 on control panel 18 has on-semiautomatic, off-reset, and manual discharge positions and enables the driver to break the alarm cycle by resetting the cycle (switch 30 is switched to the "off-reset" position) or to immediately manually discharge fire extinguishers 36 and 48 (switch 30 is set to the "discharge" position). If the driver does not take any action during the aforementioned time delay, due, for example, to his having left the cab or to his personal injuries, control unit 14 will automatically activate the appropriate solenoid valves. A solenoid valve 46 is provided for brake grid area A and a solenoid valve 38 for engine area B, and these respectively control actuation of corresponding dry chemical extinguishers 48 and 36. When activated, extinguisher 48 discharges its contents through nozzles 40 located in brake grid area A and extinguisher 36 discharges its contents through nozzles 41 located at the engine area B. Thus, the operation of extinguishers 36 and 48 after the detection of a fire is failsafe, and can be effected either manually or automatically. In addition to manual discharge switch 30, a second manual discharge switch 32 is located outside the driver's cab and is connected to logic and control circuit 14 so as to permit activation of extinguishers 36 and 48 without requiring the driver to return to his cab.

Logic and control unit 14 continually monitors thermal loops 12 and 50, optical sensors 10 and first and second pressure switches 34 and 44, described below, so as to assure proper system operation.

In general, thermal loops 12 and 50 are continuously monitored by monitoring their resistive continuity and control unit 14 distinguishes faults, such as an open circuit or a short circuit, both from normal operating conditions and fire conditions.

Optical sensors 10 are checked by control unit 14 by means of an infra-red test source 16 which is preferably located near and is optically coupled to fire detectors 10. At regular intervals, control unit 14 activates light source 16 and monitors detectors 10 to determine whether the latter detect the presence of increased IR light. In an alternate embodiment, thermal loops 12 and 50 and optical sensors 10 are checked only at system turnon rather than at regular intervals on a continuous basis.

Pressure switches 34 and 44 respectively monitor the condition of extinguishers 36 and 48 and signal control unit 14 is responsive to an irregularity in extinguisher pressure.

If monitoring of any of the thermal loops 12 and 50, the optical sensors 10, and the pressure switches 34 and 44 by control unit 14 results in the production of a fault or alarm signal, a warning light 22 on control panel 18 immediately lights to inform the driver of the existence of a problem to be corrected.

Finally, a power supply 42 provides power for control unit 14 and the circuitry associated therewith.

Figure 2:
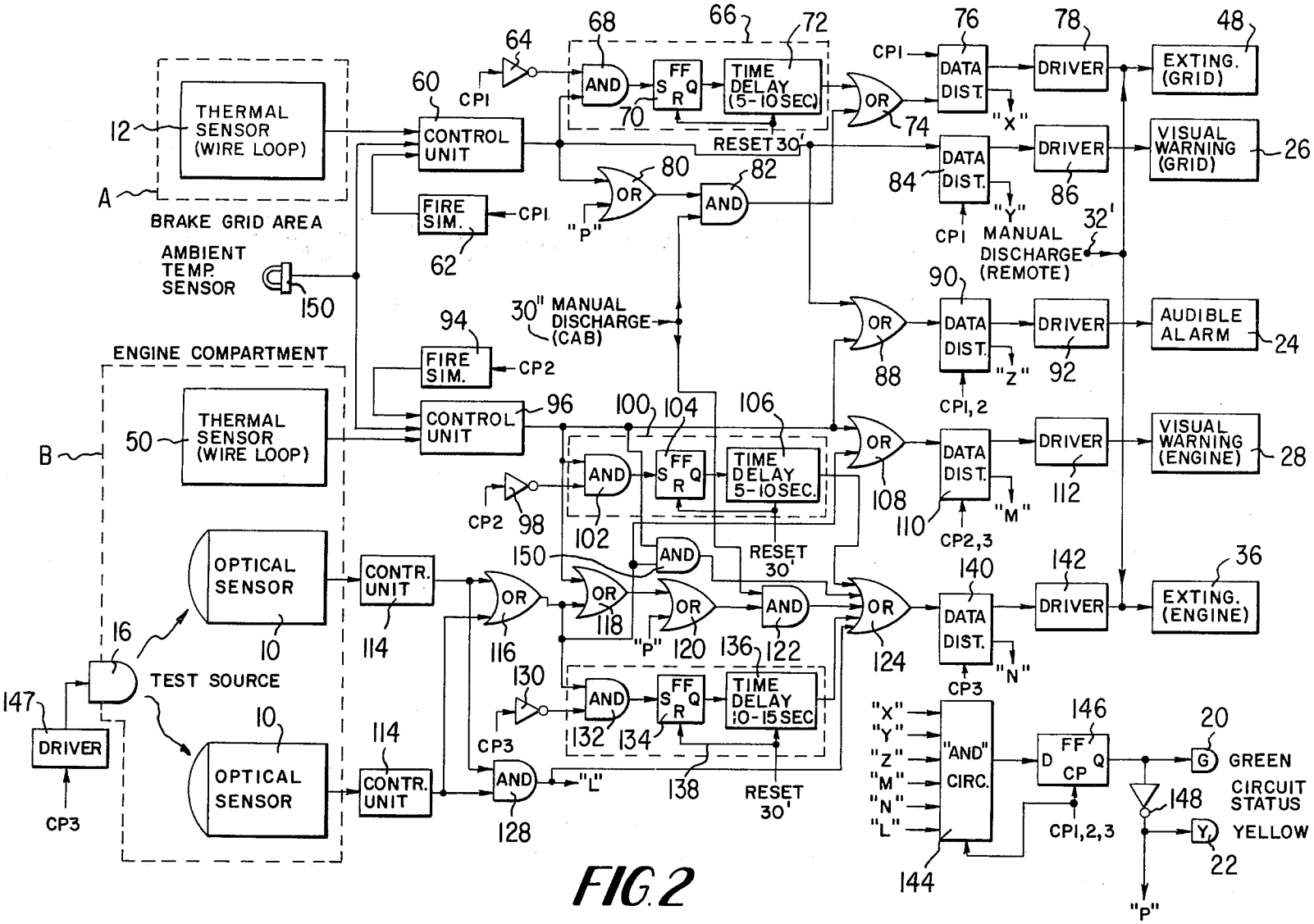
FIG. 2 is a diagrammatic block representation of control logic of a preferred embodiment.

Referring to FIG. 2, there is illustrated a preferred embodiment of the logic control unit 14 of FIG. 1 together with some of the sensors and indicators associated therewith. It is noted that during normal operations, clock pulses cp1, cp2 and cp3 which are shown in FIGS. 3A, 3B and 3C, and which, as indicated in FIG. 2, serve as testing inputs for many of the system elements, are at a logical 0 level.

The logic circuitry of FIG. 2 includes a control unit 60 which monitors the sensor 12 located in brake grid area A. Sensor 12 is, as mentioned above, a thermistor wire sensor and hence the resistance thereof decreases as temperature increases. Control unit 60 monitors the signal from sensor 12 representing the temperature in the area to be protected (brake grid area A) and compares that signal with a signal representing ambient temperature conditions. As is discussed below in connection with FIG. 4, control unit 60 produces an output when the comparison shows that the temperature in the protected area has risen to a predetermined level above the ambient temperature.

The output of control unit 60 is connected to a delay network 66 which includes an AND gate 68, a flip-flop 70 and a time delay circuit 72. A second input to AND gate 68 is provided by an inverter 64 which is connected to receive a first clock pulse input cp1 (see also FIG. 3A).

During normal operation, the clock input cp1 is at logical 0, causing the output of inverter 64 to be a logical 1. Thus, during normal operation, a signal from control unit 60 will pass through AND gate 68 and trigger flip-flop 70. Flip-flop 70 starts a time delay circuit 72, of, for example, 5 to 10 seconds. A reset signal input 30' connected to delay circuit 72 is used to reset the time delay provided by network 66 when switch 30 on panel 18 of FIG. 1 is moved to the reset position. At the end of the time delay provided by delay network 66, an output signal passes through an OR gate 74 and into a data distributor 76. Data distributor 76 is connected to a drive circuit 78 and operates as a one line-to-two line demultiplexer with cp1 as the control pulse and the output of OR gate 74 as the data. The truth table below defines the two outputs, "X" and "Driver 78," in terms of the clock pulse cp1 and the input from OR gate 74:

| | INPUTS | OUTPUTS | |
|---|---|---|---|
| CP1 | OR 74 | Driver 78 | "X" |
| 0 | 0 | 0 | 0 |
| 1 | 0 | 0 | 0 |
| 0 | 1 | 1 | 0 |
| 1 | 1 | 0 | 1 |

Thus, a "fire" signal passing through OR gate 74 will be transmitted to driver 78 when pulse cp1 is logical 0 (normal operation) and will be presented at X when the pulse cp1 is logical 1. A signal from data distributor 76 transmitted to driver 78, is amplified by the latter, and is used to activate the solenoid valve 46 of extinguisher 48 described above in connection with FIG. 1. A series of further distributors 84, 90, 110, and 140 operate in a manner similar to that described for distributor 76, the outputs thereof being respectively connected to further driver circuits 86, 92, 112 and 142 and to respective outputs Y, Z, M and N as indicated. Extinguisher 48, as well as extinguisher 36, can be operated directly from remote manual discharge input 32' which is connected to the "discharge" position of the switch 32 described above in connection with FIG. 1.

The output of control unit 60 is also connected to data distributor 84 and a control signal produced by unit 60 when the control pulse cp1 is at logical 0, is used, after passing through data distributor 84 and being amplified by driver circuit 86, to turn on light 26 located on panel 18 of FIG. 1. This same control signal is connected to one input of an OR gate 88. The output of OR gate 88 is connected to data distributor 90 which in turn is connected to driver 92 as mentioned above. The output of driver 92 is connected to audible alarm 21 which is located on control panel 18 and was discussed above with reference to FIG. 1.

Thus, upon the detection of a fire by thermal fire loop 12, the output control unit 60 will immediately energize warning light 26 and audible alarm 21, and extinguisher 48 will operate automatically after the time delay provided by time delay network 66 unless interrupted by reset signal on input line 30'.

The second thermal loop 50, is connected to a control unit 96, which corresponds to control unit 60 discussed above and the output of which is connected to a time delay network 100 comprising an AND gate 102, a flip-flop 104 and a time delay circuit 106. An inverter 98 connected to a further clock pulse terminal cp2 forms a second input to AND gate 102. In a manner similar to the operation of control unit 60 and the circuitry associated therewith, a fire detected by thermal loop 50 will cause a signal to be produced by control unit 96, triggering time delay network 100 when the input on terminal cp2 is a logical 0. A pulse from time delay network 100, after its pre-determined delay, forms one input to OR gate 124 and passes therethrough to data distributor 140. When clock pulse at terminal cp3 of data distributor 140 is a logical 0, an output signal from data distributor 140 is applied to driver 142, is amplified therein, and serves to activate fire extinguisher 36.

The output of control unit 96 also forms one input to OR gate 108. When the inputs at both terminals cp2 and cp3 are at logical 0, a signal from control unit 96 passes to, and is amplified by, driver 112, so as to energize visual indicator 28. In a similar manner, the output of control unit 96 forms the second input to OR gate 88, and through means of data distributor 90 and driver 92, energizes audible alarm 24. Thus, a fire detected by thermal loop 50 will immediately energize alarm 24, light indicator 28 and, after a time delay, will activate fire extinguisher 36. The second input to OR gate 108 is formed by the output of OR gate 116, which is derived in a manner described hereinbelow. It is noted that when a data distributor has two control inputs (e.g., distributor 110 includes control terminals cp2 and cp3), the data input will pass to the output driver (e.g., driver 112) when both controls or clock signals are at logical 0. If either control is at logical 1, the "lettered" output (e.g., "M") will receive the input data.

As described above, optical sensors 10 produce a signal representing the quantity of light received. First and second control units 114 connected to respective sensors 10 located in engine compartment B produce an output when this signal exceeds a predetermined level. The outputs of control units 114 are connected to respective inputs of an OR gate 116 and an AND gate 128. The output of OR gate 116 is connected to OR gate 108 mentioned above and thus, a signal from either control unit 114 will pass through OR gate 116, OR gate 108, data distributor 110, and driver 112 to energize warning light 28. The output of OR gate 116 is also connected to a further AND gate 132, which forms part of a time delay network 138. Network 138 also includes a flip-flop 134 and a time delay circuit 136, both of which are connected to the reset terminal of switch 30 as is indicated at 30'. An inverter 130 connected to clock pulse terminal cp3 forms the second input to AND gate 132. Since pulse cp3 is at logical 0 during normal operation and hence the output of inverter 130 is a logical 1, under these conditions, time delay network 138 will be triggered so as to provide a delay of, for example, from 10 to 15 seconds. After delay produced by time delay network 138 is completed, the signal from OR gate 116 passes through OR gate 124, data distributor 140 and driver 142 so as to activate extinguisher 36. The output of control unit 96 also is an input to AND gate 150, and the other input is the output of OR gate 116. When thermal loop 50 and either one of the optical sensors 10 detect a fire simultaneously, both inputs of AND gate 150 become logical 1 thereby bypassing timing networks 100 and 138 and immediately activating extinguisher 36.

If an output signal is produced by control unit 96 or either control unit 114, the signal will be applied to one input of an OR gate 118, the output of which is connected to further OR gate 120. The output of OR gate 120 forms one input to an AND gate 122, the second input being formed by a discharge line 30'' connected to the "discharge" position of switch 30 of FIG. 1. If the switch 30 is set to manual discharge position, a signal will pass through AND gate 122, OR gate 124, data distributor 140, and driver 142 thereby activating extinguisher 36. The output of control unit 60 is also connected to an OR gate 80, the output of which forms one input to AND gate 82. The second input to AND gate 82 is discharge line 30'' and the output is connected to OR gate 74 referred to above.

Thus, if a fire is detected by thermal loop 12 and switch 30 is moved to the manual discharge position, time delay network 66 will be bypassed and extinguisher 48 will be activated immediately. Similarly, if a fire is sensed by loop 50 or optical sensors 10 and switch 30 is set to the discharge position, extinguisher 36 will be immediately activated without waiting for the delays produced by either time delay network 100 or time delay network 138.

It is noted that OR gates 80 and 120 also include a "P" input so that system faults such as described hereinbelow, will cause the transmission of control signals through OR gate 80 and/or OR gate 120 without a fire being present. Thus, setting of switch 30 of FIG. 1 to the discharge position during a system fault permits both extinguishers 48 and 36 to be activated through AND gates 82 and 122 without any time delay.

The circuitry described above operates as described when no clock pulses are present. Clock pulses cp1, cp2, cp3 and corresponding to input terminals cp1, cp2, cp3 shown in FIGS. 3A, 3B, 3C, are test signals that check proper operation of all sensing devices. During these test pulses, normal alarm operation is inhibited as described hereinbelow.

Pulses cp1, cp2 and cp3 are short duration pulses (for example, 10 ms) and are produced at any desired repetition rate (for example, 20 Hz). In an alternative approach, pulses cp1, cp2 and cp3 appear only once, during system turn-on, to initially check proper circuit operation.

Pulse cp1 simulates the detection of a fire by thermal fire loop 12. A fire simulator 62 is connected to receive pulse cp1 and to transmit a signal to control unit 60 in response thereto, the characteristics of this signal being similar to those of the signal produced by thermal loop 12 upon the sensing of a fire. Control unit 60 is thus "fooled" and produces an output signal indicating a fire. The output of inverter 64 is a logical 0 during pulse cp1 and serves to inhibit transmission of the output of control unit 60 through AND gate 68 and hence triggering of time delay network 66. Under these conditions, data distritubor 84, which is directly connected to the output of control unit 60, produces an output at terminal Y rather than an output to driver 86, due to the presence of pulse cp1. Thus, the simulated fire condition will not affect the operation of the fire control equipment. Similarly, data distributor 90 produces an output at Z rather than an output to driver 92, so that audible alarm 21 is not activated.

The outputs X, Y, Z, M, N, and L referred to above form the inputs to an AND circuit 144 which is comprised of known AND gates and multiplexer circuits so as to present to the D input of D type flip-flop 146 a signal indicating the proper operation of each part of the circuit tested by a given clock pulse. For example, for pulse cp1, the input X should be at logical 0, input Y should be at logical 1 and input Z should be at logical 1. Further, under these conditions, the output from AND circuit 144 will be a logical 1, i.e., when pulse cp1 is present X is 0, Y is 1 and Z is 1. The output of AND circuit 144 is stored in flip-flop 146 on the trailing edge of pulse cp1. First and second status indicator lamps 20 and 22, which operate in a complementary manner, due to the connection of an inverter 148 therebetween, indicate the state of flip-flop 146. If flip-flop 146 contains a logical 1, all circuits are operating properly, and green lamp 20 lights. If flip-flop 146 contains a logical 0, there is a fault present in the system, and yellow warning light 22 lights. The output of inverter 148, which is denoted P, indicates a fault and is connected to OR gate 80 and OR gate 120 as described hereinabove.

Pulse cp2 will trigger fire simulator 94 and thereby simulate the presence of a fire to control unit 96, i.e., control 96 will detect a fire. Inverter 98 also receives pulse cp2 and serves to inhibit time delay network 100 in a manner similar to that described hereinabove relative to time delay network 66 and inverter 64. Under these conditions, data distributor 90, which also receives pulse cp2, directs the output thereof to the Z terminal and data distributor 110, which likewise receives pulse cp2, directs the output thereof to the M terminal, responsive to the presence of pulse cp2. AND circuit 144 checks the status of Z and M to be sure that both are a logical 1 under these conditions. Flip-flop 146, at the trailing edge of pulse cp2, stores the output of AND circuit 144 to indicate the results of the test.

Pulse cp3 is used to turn on a test source 16 through a driver 147 to simulate a fire to optical sensors 10. If both optical sensors 10 are working properly, both control units 114 will produce logical 1 outputs and the output L of AND gate 128 connected thereto will be a logical 1. This output L forms one input to AND circuit 144, as indicated. The output from control units 114 also passes through OR gates 116 and 108 to data distributor 110 which also receives pulse cp3 and which produces an output at terminal M under these conditions, this output forming a further input to AND circuit 144. Finally, the outputs from control units 114 are connected to the inputs of AND gate 128. A logical 1 at the output of AND gate 128 indicates that both optical sensors 10 are operating and this signal will pass through OR gate 124 producing a logical 1 on line N when data distributor 140 receives pulse cp3. For pulse cp3, AND circuit 144 checks the status of inputs M, N, and L. If M is logical 1, N is logical 1 and L is logical 1, while cp3 is present, the output of AND circuit 144 is a logical 1. At the trailing edge of pulse cp3, the output of AND circuit 144 is stored by flip-flop 146 and indicated by lamps 20 and 22.

Thus pulses cp1, cp2 and cp3 simulate fire conditions, disable normal alarm circuits through data distributors 76, 84, 90, 110 and 140, and indicate proper operating conditions by means of lamps 20 and 22. In the above described example, cp1, cp2, and cp3 are staggered in time, as shown in FIGS. 3A, 3B and 3C. This is not necessary for the operation of the circuit as all clock pulses could be simultaneous. However, with the addition of parallel circuitry to AND circuit 144, flip-flop 146 and indicators 20 and 22, the staggered clock pulses enable separate operability indications for thermal loop 12, thermal loop 50 and optical sensors 10.

Referring to FIG. 4, an ambient temperature sensor 150 which is of the thermistor type and which is shown in FIG. 2 as being connected to control units 60 and 96 is located, for example, outside the engine compartment of a mine haulage truck. Since normal operating temperatures inside the engine compartment are relatively high, ambient temperature sensor 150 provides a reference for comparison to assure that the temperatures sensed are actually due to the existence of a fire. Similarly, if ambient temperature conditions are low, ambient fire sensor 150 will insure early alarm triggering without causing false triggering in warm climates. A control unit 158, which generally corresponds to control units 60 and 96 of FIG. 2 includes a detector 154 which compares signals from thermal fire sensor 12 (or fire sensor 50 and in the case of control unit 96) and ambient thermal sensor 150 and responsive to a predetermined difference, provides an output signal at output terminal 156. In addition, detector 154 also compares the output of thermal fire sensor 12 with a signal from a maximum temperature alarm circuit 152 which provides an output representing a maximum temperature that a protected area, e.g., the engine compartment B, is permitted to reach. Thus, detector 154 will provide an output 156 when thermal fire sensor 12 registers a pre-set maximum, regardless of ambient temperature conditions. Thus, control units 60 and 96 of FIG. 2 will, as noted above, provide an output when the comparator therein (corresponding to detector 154 of FIG. 4) indcates that fire conditions exist.

Although the invention has been described with respect to an examplary embodiment thereof, it will be understood that variations and modifications can be effected in these embodiments without departing from the scope and spirit of the present invention.

We claim:

1. A fire protection system comprising;

at least one fire sensing means;

means, including testing pulse means, for continually monitoring said fire sensing means to determine whether said fire sensing means is in proper operating condition;

first and second system operational status indicating means for indicating, respectively, that said fire sensing means is operating properly and said fire sensing means is operationally faulty;

means connected to said fire sensing means for indicating that a fire is being sensed by said fire sensing means;

means connected to said monitoring means and to said system operational status indicating means, and responsive to said monitored operating condition of said fire sensing means and operation of said testing pulse means for enabling selective activation of said first and second operational status indicating means and concurrently therewith inhibiting by operation of said testing pulse means said operation of said fire sensing indicating means;

fire extinguishing means;

further means connected to said fire sensing means and responsive to the output thereof for controlling said fire extinguishing means;

means for providing manual operation of said fire extinguishing means; and means connected to said further means for indicating the proper operating condition of said fire extinguishing means.

2. A fire protection system as claimed in claim 1 wherein said fire sensing means includes at least one optical fire sensor.

3. A fire protection system as claimed in claim 2 wherein said at least one optical fire sensor operates in or near the infra-red region of the spectrum.

4. A fire protection system as claimed in claim 1 wherein said monitoring means includes, means for monitoring resistive continuity of said fire sensing means so as to distinguish between circuit faults and changes in condition caused by a fire;

a source of test pulses produced by said testing pulse means;

means responsive to said test pulses for simulating a fire condition; and means for disabling said controlling means for said fire extinguishing means during a said test pulse so as to prevent operation of said fire extinguishing means during said simulated fire condition.

5. A fire protection system as claimed in claim 4 wherein said disabling means includes a plurality of data distributing means which receive said test pulses and, responsive thereto, divert the signal produced by said fire sensing means from said fire extinguishing means, to a status monitoring means for indicating the proper operating condition of the circuit checked by said test pulses.

6. A fire protection system as claimed in claim 4 wherein said means for simulating a fire condition includes a light source, optically coupled to said fire sensors, for providing short duration light pulses at regular intervals responsive to said test pulses.

7. A fire protection system as claimed in claim 1 wherein said further means includes means for automatically activating said fire extinguisher means when a fire condition is sensed by said fire sensing means and time delay means for introducing a pre-determined time delay between the time a fire condition is sensed by said fire sensing means and said automatic activation of said fire extinguishing means.

8. A fire protection system as claimed in claim 7 wherein said manual operating means includes means for bypassing said time delay means and providing for manual operation of said fire extinguishing means by an operator so as to enable immediate extinguishing of a fire.

9. A fire protection system as claimed in claim 1 wherein said indicating means includes visual and audible devices.

10. A fire protection system as claimed in claim 1 wherein said fire extinguishing means includes a pressurized extinguisher containing a dry powder chemical capable of extinguishing fires;

a solenoid valve for controlling actuation of said extinguisher responsive to said control means;

at least one nozzle connected to said extinguisher and positioned so as to permit distribution of said dry chemical in a pre-determined manner when said solenoid valve is activated responsive to said control means.

11. A fire protection system comprising at least one fire sensing means including a thermal wire loop;

means for continually monitoring said fire sensing means to determine whether said fire sensing means is in proper operating condition;

indicating means connected to said monitoring means for indicating whether said fire sensing means is operating properly;

means connected to said fire sensing means for indicating that a fire is being sensed by said fire sensing means;

fire extinguishing means;

control means connected to said fire sensing means for controlling said fire extinguishing means responsive to the output of said fire sensing means;

means for providing manual operation of said fire extinguishing means; and means connected to said control means for indicating the proper operating condition of said fire extinguishing means.

12. A fire protection system comprising at least one fire sensing means including a thermal fire sensor and means connected to said fire sensor for compensating for the ambient temperature conditions of said fire sensor;

means for continually monitoring said fire sensing means to determine whether said fire sensing means is in proper operating condition;

indicating means connected to said monitoring means for indicating whether said fire sensing means is operating properly;

means connected to said fire sensing means for indicating that a fire is being sensed by said fire sensing means;

fire extinguishing means;

control means connected to said fire sensing means for controlling said fire extinguishing means responsive to the output of said fire sensing means;

means for providing manual operation of said fire extinguishing means; and means connected to said control means for indicating the proper operating condition of said fire extinguishing means.

13. A fire protection system as claimed in claim 12 wherein said compensating means comprises:

an ambient temperature sensor for producing an electrical signal representative of the ambient temperature;

means for generating a signal representing the maximum level said ambient temperature is permitted to reach;

means for comparing the output of said thermal fire sensor with said ambient temperature sensor signal and said maximum temperature signal and producing an output when said thermal fire sensor output exceeds the lower of the latter two signals by a predetermined amount.

14. An automatic fire protection system wherein a fire extinguisher device is automatically activated upon the sensing of a fire after a pre-determined time delay unless an operator intervenes, said system comprising at least one fire sensor;

means connected to said fire sensor, for detecting the state of said fire sensor;

an alarm means;

means, connected to said detecting means, for activating said alarm means;

extinguisher activating means, connected to said detecting means, for automatically activating said extinguisher device;

delay means for introducing a time delay between said monitoring means and said extinguisher activating means;

operator controlled means for disabling said extinguisher activating means;

and means for by-passing said time delay means so as to permit immediate manual activation of the fire extinguisher device.

15. A fire protection system comprising:

at least one fire sensing means;

means for continually monitoring said fire sensing means to determine whether said fire sensing means is in proper operating condition;

indicating means connected to said monitoring means for indicating that a fire is being sensed by said fire sensing means;

fire extinguishing means;

control means connected to said fire sensing means for controlling said fire extinguishing means responsive to the output of said fire sensing means wherein said control means includes means for automatically activating said fire extinguishing means when a fire condition is sensed by said fire sensing means and time delay means for introducing a pre-determined time delay between the time a fire condition is sensed by said fire sensing means and said automatic activation of said fire extinguishing means;

means for providing manual operation of said fire extinguishing means wherein said manual operating means includes means for disabling said time delay means and resetting said control means, so as to prevent said fire extinguishing means from being activated automatically; and means connected to said control means for indicating the proper operating condition of said fire extinguishing means.

* * * * *